US010398237B2

(12) United States Patent
Chen

(10) Patent No.: US 10,398,237 B2
(45) Date of Patent: Sep. 3, 2019

(54) SECURITY DISPLAY UNIT

(71) Applicant: Yi-Fu Chen, Taichung (TW)

(72) Inventor: Yi-Fu Chen, Taichung (TW)

( * ) Notice: Subject to any disclaimer, the term of this patent is extended or adjusted under 35 U.S.C. 154(b) by 0 days.

(21) Appl. No.: 16/028,756

(22) Filed: Jul. 6, 2018

(65) Prior Publication Data

US 2018/0310728 A1 Nov. 1, 2018

Related U.S. Application Data

(63) Continuation-in-part of application No. 14/862,156, filed on Sep. 23, 2015, now abandoned.

(51) Int. Cl.

| | |
|---|---|
| ***A47F 5/00*** | (2006.01) |
| ***B65D 73/00*** | (2006.01) |
| ***A47F 7/00*** | (2006.01) |
| *B25B 13/46* | (2006.01) |

(52) U.S. Cl.

CPC ..... *A47F 5/0006* (2013.01); *A47F 7/0021* (2013.01); *B65D 73/0064* (2013.01); *B25B 13/46* (2013.01); *B25B 13/461* (2013.01)

(58) Field of Classification Search

CPC ..... A47F 5/0006; A47F 2005/0012; Y10T 403/587; Y10T 403/592; Y10T 403/7018; Y10T 403/7021; B65D 73/0035; B65D 73/0064; B65D 2211/00

See application file for complete search history.

(56) References Cited

U.S. PATENT DOCUMENTS

| | | | | |
|---|---|---|---|---|
| 6,464,840 | B1 * | 10/2002 | McCann | B65D 73/0014 206/349 |
| 6,883,767 | B1 * | 4/2005 | Huang | A47F 5/0006 206/378 |
| 7,527,150 | B2 * | 5/2009 | Tong | A47F 7/024 206/376 |
| 7,565,973 | B2 * | 7/2009 | Chang | B65D 73/0064 206/378 |
| 2012/0074009 | A1 * | 3/2012 | Chang | B65D 73/0064 206/349 |

* cited by examiner

*Primary Examiner* — Michael P Ferguson
(74) *Attorney, Agent, or Firm* — Rosenberg, Klein & Lee

(57) ABSTRACT

A display unit includes a plate and a ring. The ring has a through hole with which a first end of a security member is engaged. The second end of the security member extends beyond the through hole. The security member is pivotable relative to the through hole. An insertion hole is defined in the second end of the security member so as to receive a hand tool therein. The security member includes an opening communicating with the insertion hole. An L-shaped restriction member is connected to a slit defined in the first end and the outside surface of the security member. The restriction member has an engaging portion which extends through the opening and inserted into a gap between a bead and a reception hole for receiving the bead of the hand tool to prevent the hand tool from being separating from the ring.

3 Claims, 6 Drawing Sheets

SECURITY DISPLAY UNIT

This application is a Continuation-In-Part application of applicant's former patent application with application Ser. No. 14/862,156, filed on Sep. 23, 2015.

BACKGROUND OF THE INVENTION

1. Fields of the Invention

2. Descriptions of Related Art

The conventional display unit generally includes a first plate for being hanged on a display board or a wall. The first plate has a first connection portion. A second plate has a second connection portion which is connected to the first connection. The first plate further has a rotary portion. A cover is connected to the second connection portion so as to form a room therebetween. The hand tool is inserted into the room and connected to the rotary portion such that the customers can rotate the handle extending from the display unit to try and operate the ratchet means of the hand tool. Nevertheless, the conventional display unit is complicated and required a lot of time to assemble.

U.S. Pat. No. 7,565,973 discloses a suspension tag for socket wrench, wherein the filling cap includes a projection extending from an inside surface of the top panel of the receiving frame section thereof, and the projection is located corresponding to the spring-biased locking sphere of a driving piece of a hand tool so as to restrict the hand tool from being separated from the fitting cap. However, the projection cannot be changed because it is integral with the fitting cap. Besides, the manufacturing for integrally formed the projection with the fitting cap is difficult.

The present invention intends to provide a display unit that includes a restriction member that is replaceable and is easily assembled from outside of the security member so as to eliminate the shortcomings mentioned above.

SUMMARY OF THE INVENTION

The present invention relates to a display unit comprises a plate and a ring, wherein the ring has a through hole which includes a flange extending radially and inward from the inner periphery thereof. Multiple teeth are formed along the inner periphery of the flange.

A security member includes having the first end thereof engaged with the through hole, and a second end of the security member extends beyond the through hole. Two first extension extend radially from the periphery of the second end of the security member. Two second extensions extend radially from outside of the security member and are located at an axial distance from the first extensions. A gap is formed axially between the two first extensions and the two second extensions. The two first extensions are located between the two second extensions. The flange is rotatably located in the gap between the two first extensions and the two second extensions. The security member is pivotable relative to the through hole. An insertion hole is defined in the second end of the security member. An opening is defined through one of sidewalls of the insertion hole. The security member has a slit defined in the end face of the first end and the outside surface of the security member. A ridge extends from the outside of the security member and is located between the two first extensions and two second extensions. The ridge is removably engaged with the teeth of the flange when the security member is rotatable relative to the flange.

A restriction member is formed by bending a wire into an L-shaped restriction member. An engaging portion extends from one of two ends of the restriction member. The restriction member is engaged with the slit from the outside of the first end of the security member and is in flush with the outside of the security member. The engaging portion extends through the opening and is located in the insertion hole. The engaging portion is inserted into a gap between a bead of a hand tool and a reception hole for receiving the bead of the hand tool.

Preferably, a slot is defined axially through the security member so as to form a first part and a second part. At least one bridge is connected between the first part and the second part. The first part and the second part are clamp the hand tool.

Preferably, the slit is not defined through the wall of the security member and the restriction member is engaged with the slit and in flush with the outside surface of the security member.

The primary object of the present invention is to provide a display unit wherein the engaging portion of the restriction member is inserted into the gap between the bead and the reception hole for receiving the bead of the hand tool, so that when the hand tool is pulled away from the display unit, the pulling direction deeply pushes the engaging portion into the gap to prevent the hand tool from being separated from the display unit.

Another object of the present invention is to provide a display unit wherein the position of the restriction member relative to the display unit allows the assemblers to easily assemble the display unit regardless of the sizes of the assemblers' fingers.

Yet another object of the present invention is to provide a display unit wherein the restriction member is easily assembled to the slit of the security member from outside of the first end of the security member. The restriction member is easily made and the shape and position of the engaging portion can be varied according to needs. The restriction member is replaceable.

The present invention will become more obvious from the following description when taken in connection with the accompanying drawings which show, for purposes of illustration only, a preferred embodiment in accordance with the present invention.

DETAILED DESCRIPTION OF THE PREFERRED EMBODIMENT

Figure 1:
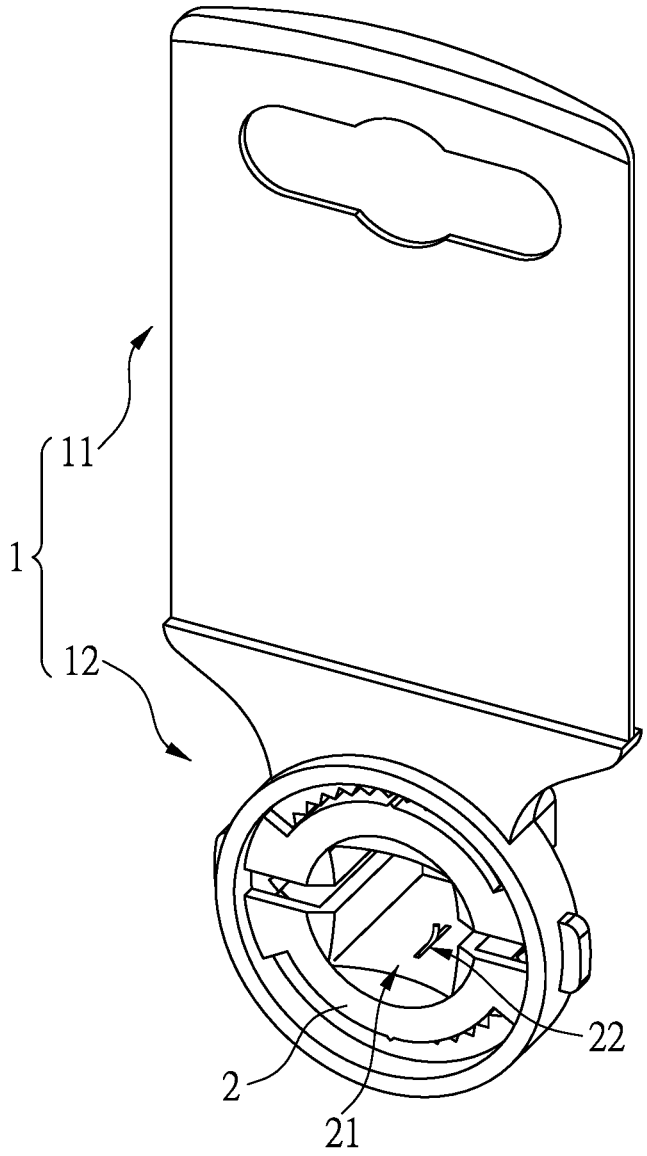
FIG. 1 is a perspective view to show the display unit of the present invention.

Referring to FIGS. 1 to 6, the display unit 1 of the present invention comprises a plate 11 and a ring 12 which is connected to the plate 11. The plate 11 has a hanging hole and the ring 12 has a through hole 121 defined therethrough. The through hole 121 has a flange 122 extending radially and inward from the inner periphery thereof. Multiple teeth 123 are formed along the inner periphery of the flange 122.

Figure 2:
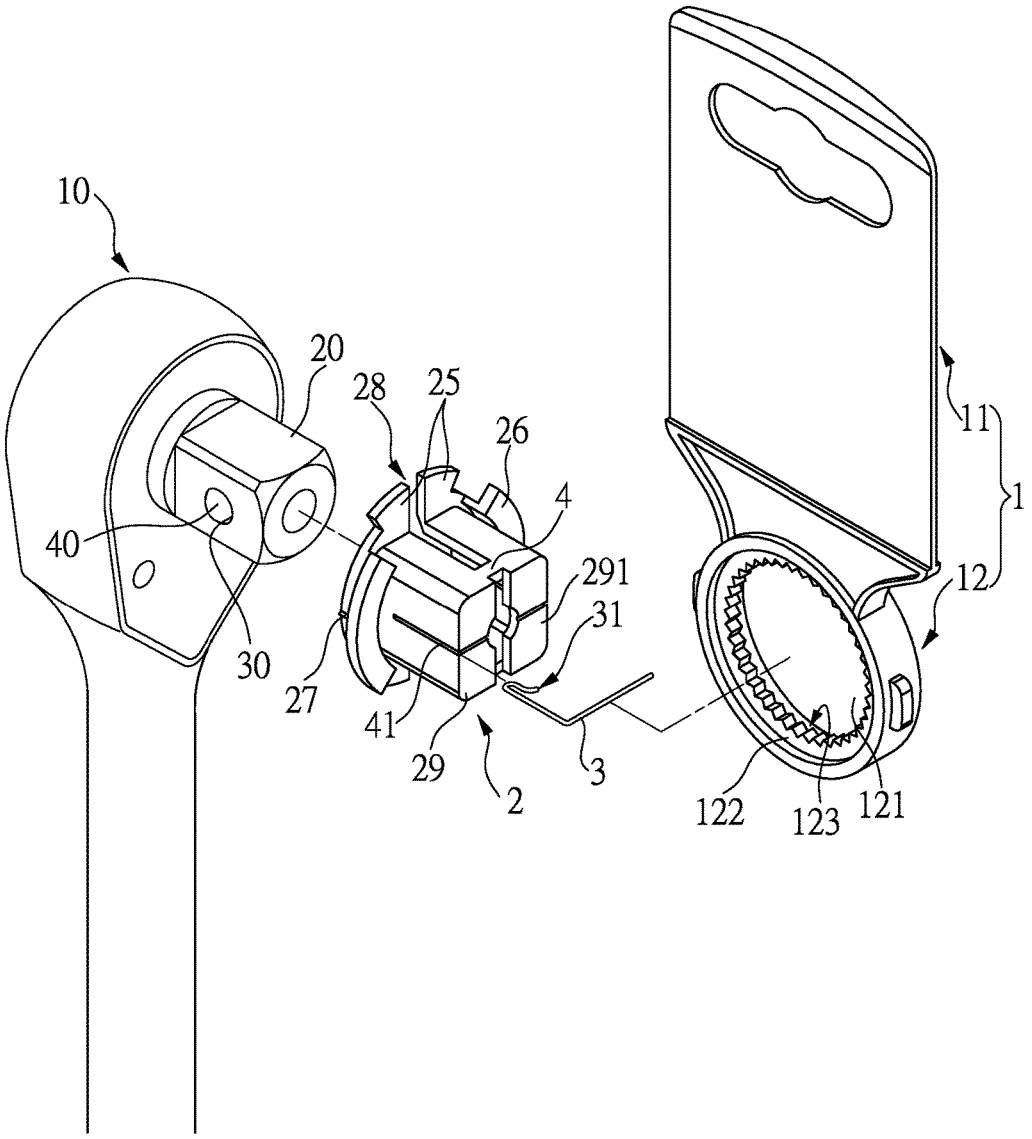
FIG. 2 is an exploded view of the display unit of the present invention.
Figure 3:
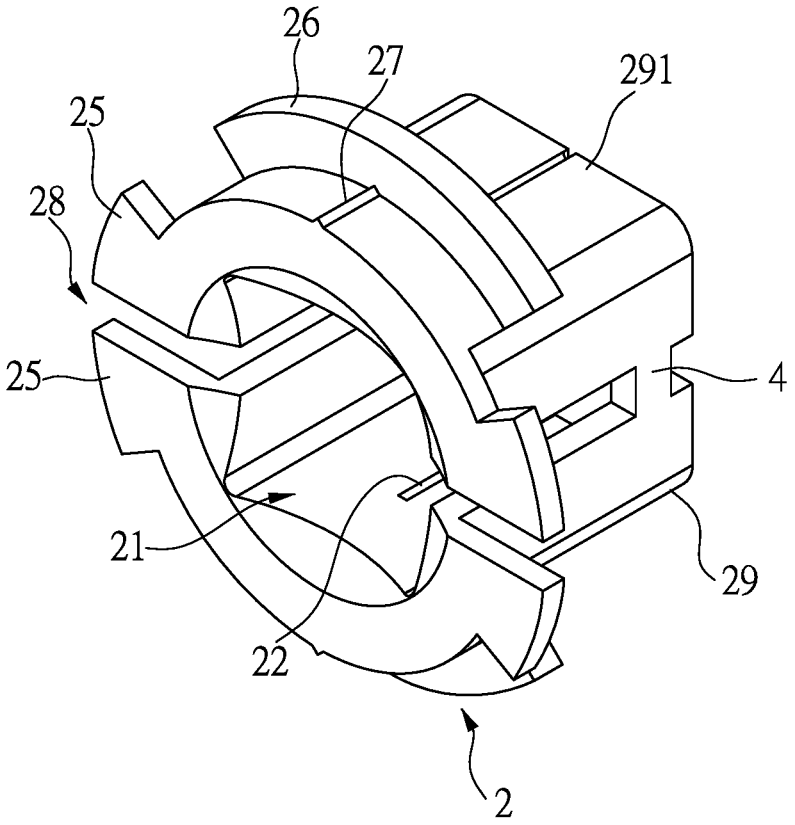
FIG. 3 is a perspective view to show the security member of the display unit of the present invention.
Figure 4:
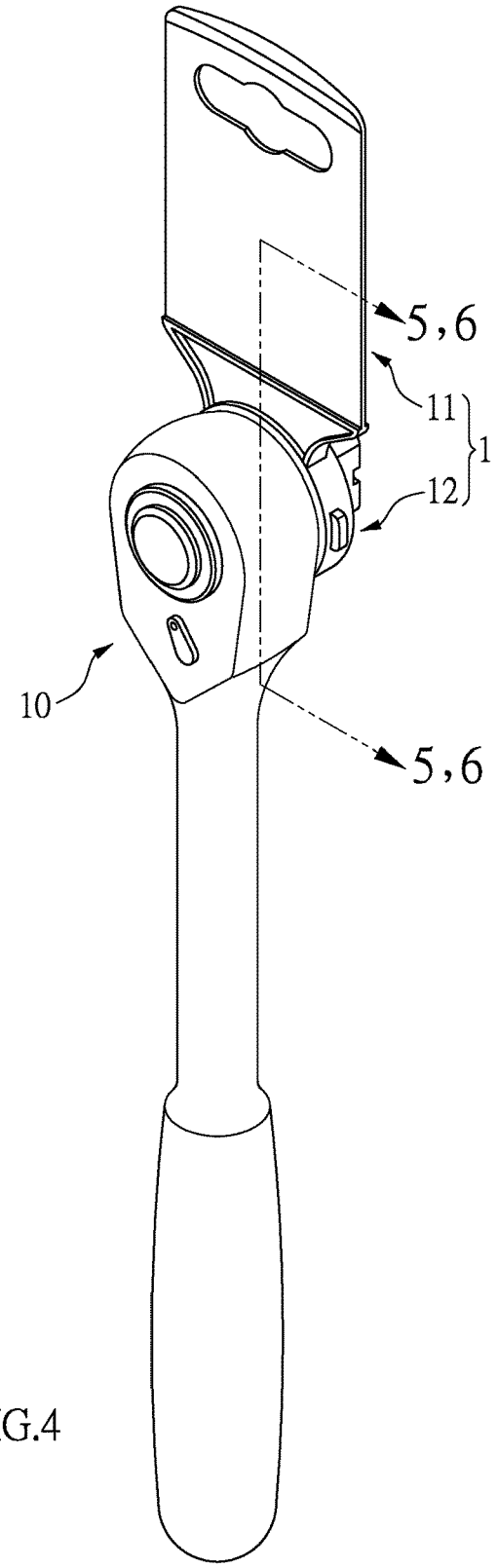
FIG. 4 shows that a hand tool is connected to the display unit of the present invention.
Figure 5:
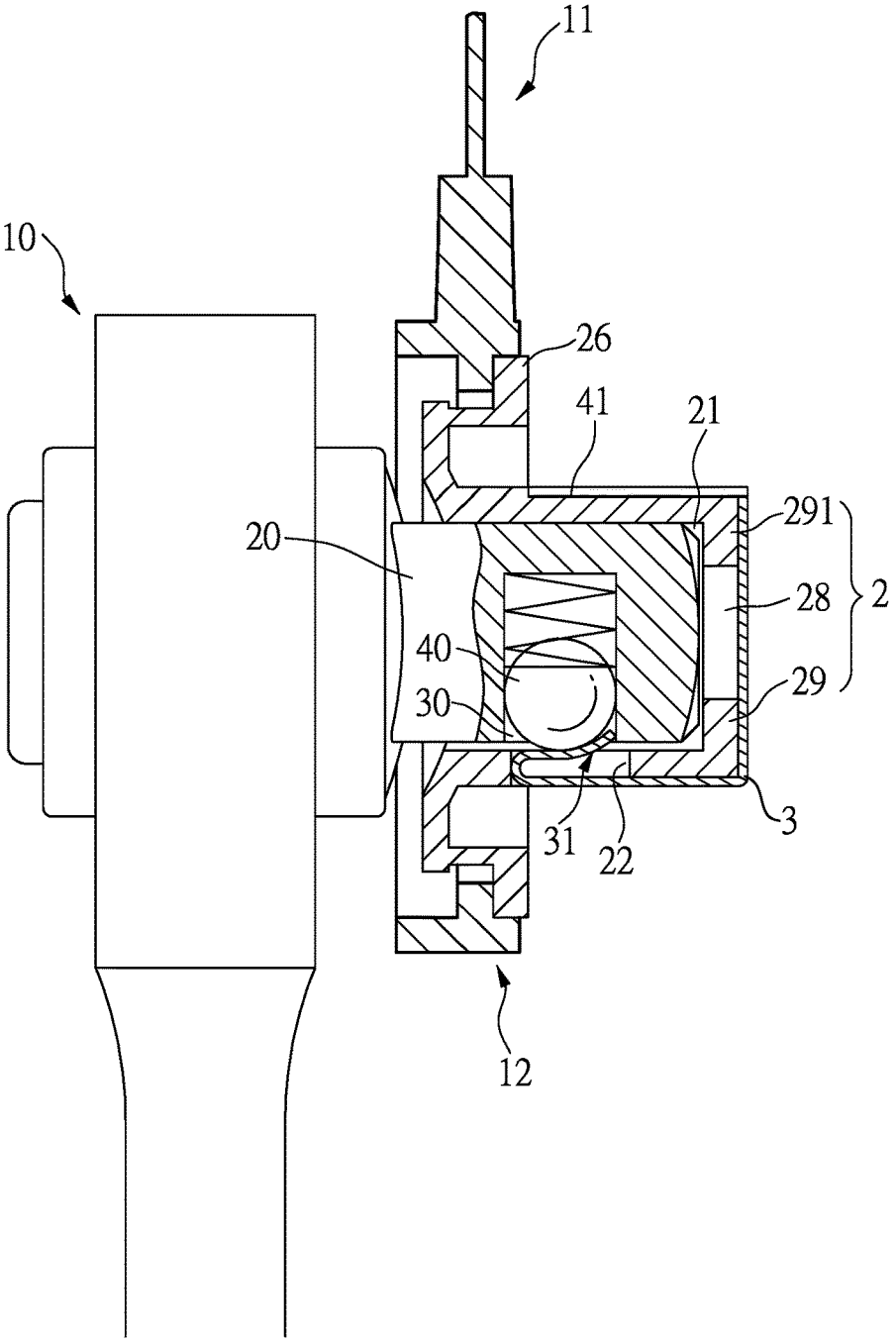
FIG. 5 is a cross sectional view to show that the engaging portion of the restriction member is inserted into the gap between the bead of the hand tool and the reception hole for receiving the bead of the hand tool.

A security member 2 includes a first end and a second end, wherein the first end of the security member 2 is engaged with the through hole 121, and the second end of the security member 2 extends beyond the through hole 121. Two first extension 25 extend radially from the periphery of the second end of the security member 2, and two second extensions 26 extend radially from outside of the security member 2 and located at an axial distance from the first extensions 25. The two first extensions 25 are located between the two second extensions 26, Therefore, a gap is formed axially between the two first extensions 25 and two second extensions 26. The flange 122 is rotatably located in the gap between the two first extensions 25 and the two second extensions 26. The security member 2 is pivotable relative to the through hole 121. An insertion hole 21 is defined in the second end of the security member 2, and an opening 22 is defined through one of sidewalls of the insertion hole 21. The security member 2 further includes a slit 41 defined in the end face of the first end of the security member 2 and the outside surface of the security member 2 as shown in FIG. 2. A ridge 27 extends from the outside of the security member 2 and located between the two first extensions 25 and two second extensions 26 as shown in FIG. 3. A slot 28 is defined axially through the security member 2 so as to form a first part 29 and a second part 291. At least one bridge 4 is connected between the first part 29 and the second part 291. The first part 29 and the second part 291 can resiliently clamp the engaging block 20 of the hand tool 10. The ridge 27 is removably engaged with the teeth 123 of the flange 122 when the security member 2 is rotatable relative to the flange 122.

A restriction member 3 is formed by bending a wire into an L-shaped restriction member 3. An engaging portion 31 extends from one of two ends of the restriction member 3. The restriction member 3 is engaged with the slit 41 from in the end face of the first end of the security member 2 and is in flush with the outside surface of the security member 2. The engaging portion 31 extends through the opening 22 and is located in the insertion hole 21. The engaging portion 31 is inserted into a gap between a bead 40 of a hand tool 10 and a reception hole 30 for receiving the bead 40 of the hand tool 10.

Figure 6:
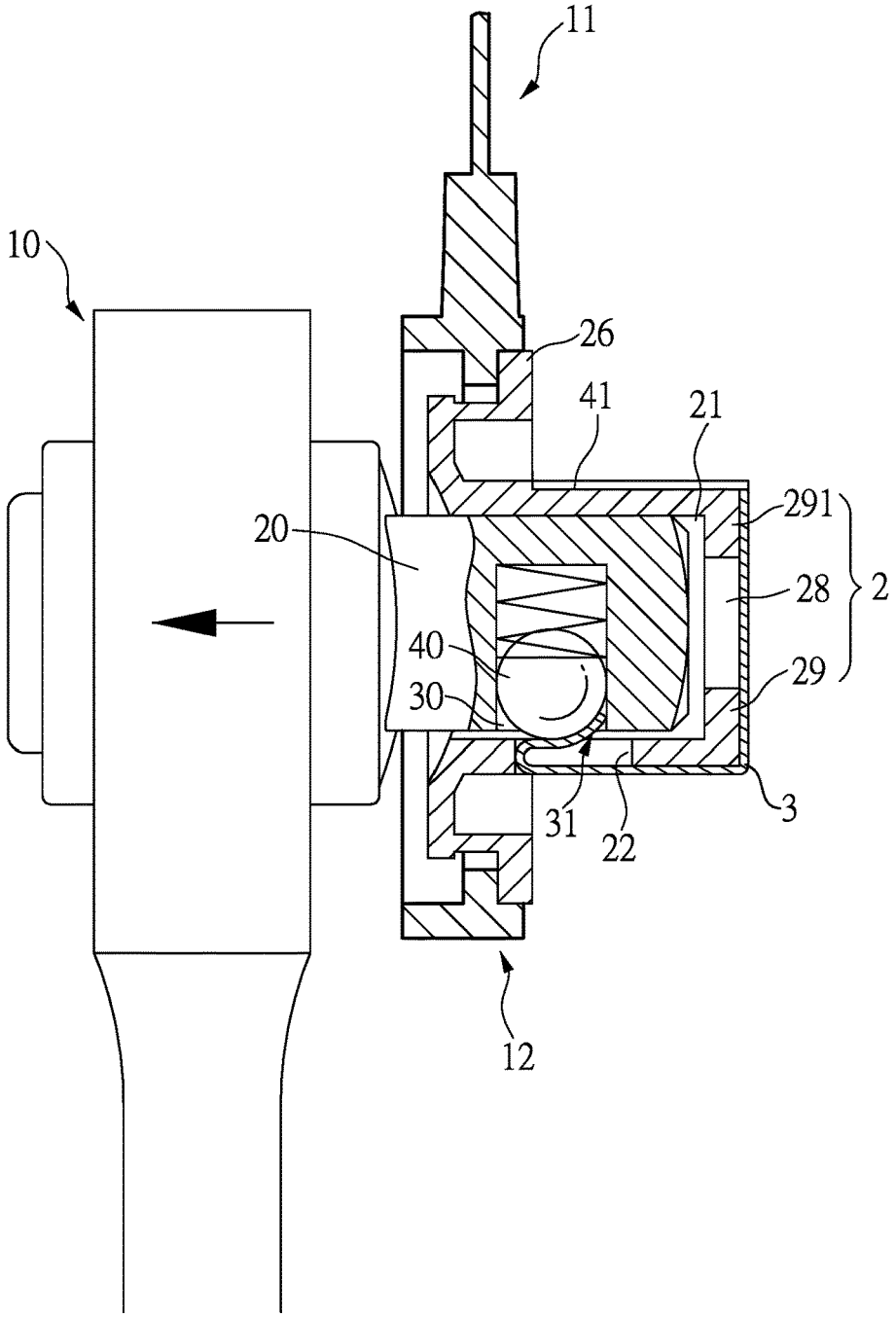
FIG. 6 is a cross sectional view to show that when the hand tool is pulled away from the display unit, the engaging portion of the restriction member is further deeply inserted into the gap between the bead of the hand tool and the reception hole for receiving the bead of the hand tool.

As shown in FIG. 6, when a person tries to pull the hand tool 10 out from the display unit 1 without permission, the pulling direction makes the engaging portion 31 to be further deeply inserted into the gap between the bead 40 and the reception hole 30 for receiving the bead 40. Therefore, the hand tool 10 is prevented from being stolen by pulling it away from the display unit 1. Furthermore, the position of the restriction member 3 relative to the display unit 1 allows the assemblers to easily assemble the display unit 1 regardless of the sizes of the assemblers' fingers.

Furthermore, the restriction member 3 is easily assembled to the slit 41 of the security member 2 from outside of the first end of the security member 2. It is noted that the slit 41 is not defined through the wall of the security member 2 and the restriction member 3 is engaged with the slit 41 and in flush with the end face of the first rend of the security member 2 and the outside surface of the security member 2. The restriction member 3 is easily made, and the shape and position of the engaging portion 31 can be varied according to needs. The restriction member 3 is replaceable.

While we have shown and described the embodiment in accordance with the present invention, it should be clear to those skilled in the art that further embodiments may be made without departing from the scope of the present invention.

What is claimed is:

1. A display unit for being connected to a hand tool, comprising:

a plate and a ring attached to the plate, the ring having a through hole defined therethrough, the through hole having a flange extending radially and inward from an inner periphery thereof, multiple teeth being formed along an inner periphery of the flange;

a security member having a first end engaged with the through hole, a second end of the security member extending beyond the through hole, two first extension extending radially from a periphery of the second end of the security member, two second extensions extending radially from an outside surface of a circumferential sidewall of the security member and located at an axial distance from the first extensions, a gap formed axially between the two first extensions and two second extensions, the two first extensions located circumferentially between the two second extensions, the flange rotatably located in the gap between the two first extensions and the two second extensions, the security member being pivotable relative to the through hole, an axially-extending insertion hole defined in the second end of the security member, an opening defined radially through one of the sidewalls of the insertion hole, a slit defined in an axial end face of the first end of the security member and an outside surface of the circumferential sidewall of the security member, a ridge extending from the outside surface of the security member and located between the two first extensions and two second extensions, the ridge being removably engaged with the teeth of the flange when the security member is rotatable relative to the flange, and a restriction member being formed by bending a wire into an L-shaped restriction member which includes two legs, an engaging portion radially extending from one of two ends of the restriction member and disposed on one of the two legs of the L-shaped restriction member, the restriction member engaged with the slit from an outside of the first end of the security member such that the one of the two legs of the L-shaped restriction member is received within a portion of the slit disposed within the outside surface of the circumferential sidewall of the security member, and such that the other one of the two legs of the L-shaped restriction member is received within another portion of the slit disposed within the axial end face of the first end of the security member, the engaging portion extending through the opening and located in the insertion hole, the engaging portion adapted to be inserted into a gap between a bead of a hand tool and a reception hole of the hand tool for receiving the bead of the hand tool.

2. The display unit as claimed in claim 1, wherein a slot is defined axially through the circumferential sidewall of the security member so as to form a first part and a second part, at least one bridge is connected between the first part and the second part, and the first part and the second part are adapted to clamp the hand tool.

3. The display unit as claimed in claim 1, wherein the slit is defined within and partially extends through the end face of the first end of the security member and the circumferential sidewall of the security member, the restriction member is engaged with the slit and is flush with the end face of the first end of the security member and the outside surface of the security member.

* * * * *